US011717875B2

(12) United States Patent
Ogundare et al.

(10) Patent No.: US 11,717,875 B2
(45) Date of Patent: Aug. 8, 2023

(54) ELECTRICALLY INITIATED ELASTOMER MEMBER EXPANSION FOR CONTROLLING TUBING MEMBER ASSEMBLY DIAMETER

(71) Applicant: Saudi Arabian Oil Company, Dhahran (SA)

(72) Inventors: Tolu Ogundare, Dhahran (SA); Saad Al-Driweesh, Alhufof (SA); Abdulaziz M Al Sagr, Al-Jishah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/513,348

(22) Filed: Oct. 28, 2021

(65) Prior Publication Data

US 2023/0139096 A1 May 4, 2023

(51) Int. Cl.

| | |
|---|---|
| ***E21B 33/12*** | (2006.01) |
| ***B21D 39/08*** | (2006.01) |
| ***E21B 47/113*** | (2012.01) |
| ***E21B 47/12*** | (2012.01) |

(52) U.S. Cl.

CPC ..... *B21D 39/08* (2013.01); *E21B 33/12* (2013.01); *E21B 47/113* (2020.05); *E21B 47/12* (2013.01); *E21B 47/138* (2020.05)

(58) Field of Classification Search

CPC ..... B21D 39/08; E21B 33/12; E21B 47/113; E21B 47/12; E21B 47/138

See application file for complete search history.

(56) References Cited

U.S. PATENT DOCUMENTS

| | | | | |
|---|---|---|---|---|
| 2,600,848 | A * | 6/1952 | Collins | E21B 33/08 277/330 |
| 5,457,977 | A * | 10/1995 | Wilson | B21D 26/14 72/430 |
| 6,840,325 | B2 | 1/2005 | Stephenson | |
| 7,070,001 | B2 | 7/2006 | Whanger et al. | |
| 8,969,152 | B2 | 3/2015 | Chan et al. | |
| 9,523,257 | B2 | 12/2016 | Hallundbaek et al. | |
| 9,540,893 | B2 * | 1/2017 | Freyer | E21B 33/127 |

(Continued)

FOREIGN PATENT DOCUMENTS

| | | |
|---|---|---|
| CN | 105909180 A | 8/2016 |
| GB | 2581077 A | 8/2020 |

(Continued)

*Primary Examiner* — Steven A MacDonald

(74) *Attorney, Agent, or Firm* — Dinsmore & Shohl LLP

(57) ABSTRACT

A system for controlling tubing member assembly diameter includes a control unit, a computing device, a tubing member assembly, and an elastomer member. The tubing member assembly includes an outer pipe member that defines a static diameter and an inner pipe member having an outer surface and defining a dynamic diameter that changes from a first inner pipe member value to a second inner pipe member value. The elastomer member is disposed between the outer pipe member and the inner pipe member such that an inner area of the elastomer member is disposed on the outer surface of the inner pipe member. The elastomer member expands from a first position to a second position to constrict the dynamic diameter from the first inner pipe member value to the second inner pipe member value responsive to receiving an electrical signal from the control unit.

19 Claims, 6 Drawing Sheets

(56) References Cited

U.S. PATENT DOCUMENTS

| | | | | |
|---|---|---|---|---|
| 2003/0217844 | A1* | 11/2003 | Moyes | B21D 15/06 166/135 |
| 2006/0021749 | A1* | 2/2006 | Schaeper | E21B 33/063 166/85.4 |
| 2011/0146999 | A1* | 6/2011 | Stanton | E21B 43/122 222/129 |
| 2012/0000670 | A1* | 1/2012 | Kenworthy | E21B 43/36 166/372 |
| 2013/0092373 | A1* | 4/2013 | Arellano | E21B 43/121 166/267 |
| 2015/0053410 | A1* | 2/2015 | Arellano | E21B 43/121 166/309 |
| 2017/0254194 | A1* | 9/2017 | Mazyar | G01L 1/20 |
| 2018/0275686 | A1* | 9/2018 | Shariff | G05D 7/01 |

FOREIGN PATENT DOCUMENTS

| | | |
|---|---|---|
| RU | 2422617 C1 | 6/2011 |
| RU | 2664079 C2 | 8/2018 |

* cited by examiner

ELECTRICALLY INITIATED ELASTOMER MEMBER EXPANSION FOR CONTROLLING TUBING MEMBER ASSEMBLY DIAMETER

TECHNICAL FIELD

The present disclosure relates to adjusting diameters of tubing member assemblies, and more specifically, to the diameters of one or more pipe members positioned as part of the tubing member assemblies that are constricted by electrically expandable elastomer members disposed on these pipe members.

BACKGROUND

One of the biggest challenges faced by the oil and gas industry is reducing liquid loading, which is a common occurrence during production operations conducted using oil and gas wells. Liquid loading refers to the accumulation of liquids (e.g., water) within a well that impair well production, such as the ability of the well to extract a particular threshold level of oil and gas. Various current techniques are utilized to reduce liquid loading. These techniques include reducing wellhead pressure with a compressor in order to increase fluid velocity within the wellbore; using chemicals and foaming agents to increase surface tension and reduce liquid density; and reducing the cross section of the area through which fluid flows by replacing the tubing currently installed in the well with another tubing with a smaller diameter. However, these current techniques are expensive, labor intensive, and only partially reduce liquid loading. Accordingly, a need exists in the industry for an efficient and cost effective liquid loading reduction technique.

SUMMARY

In one aspect, a system for controlling the contraction of a tubing member assembly is provided. The system includes a control unit, a computing device that is communicatively coupled to the control unit and includes a memory component that stores logic and a processor for executing the logic, a tubing member assembly, and an elastomer member. The tubing member assembly includes an outer pipe member having an inner region and defining a static diameter and an inner pipe member having an outer surface and defining a dynamic diameter that changes from at least a first inner pipe member value to a second inner pipe member value, wherein the dynamic diameter is always smaller than the static diameter, and wherein the inner pipe member is disposed within the outer pipe member. The elastomer member, which is communicatively coupled to the control unit, is disposed between the outer pipe member and the inner pipe member such that an inner area of the elastomer member is disposed on the outer surface of the inner pipe member, and the elastomer member expands from a first position to a second position to constrict the dynamic diameter from the first inner pipe member value to the second inner pipe member value responsive to receiving an electrical signal from the control unit.

In another aspect, an expandable elastomer member system for controlling the contraction of a tubing member assembly is provided. The expandable elastomer member system includes a control unit, a computing device that is communicatively coupled to the control unit and includes a memory component that stores logic and a processor for executing the logic, an outer pipe member, an inner pipe member having an outer surface and defining a dynamic diameter, and an elastomer member. The elastomer member is disposed between the outer pipe member and the inner pipe member such that an inner area of the elastomer member is disposed on the outer surface of the inner pipe member. The elastomer member receives an electrical signal from the control unit, and expands from a first position to a second position to constrict the dynamic diameter of the inner pipe member from a first inner pipe member value to a second inner pipe member value responsive to the electrical signal from the control unit.

In another aspect, a system for controlling the contraction of a tubing member assembly using a conductive element embedded elastomer member is provided. The system includes a control unit, a computing device that is communicatively coupled to the control unit and includes a memory component that stores logic and a processor for executing the logic, a tubing member assembly including an outer pipe member having an inner region and defining a static diameter and an inner pipe member having an outer surface and defining a dynamic diameter that changes from at least a first inner pipe member value to a second inner pipe member value, wherein the dynamic diameter is always smaller than the static diameter, and wherein the inner pipe member is disposed within the outer pipe member, and an elastomer member, communicatively coupled to the control unit, is disposed between the outer pipe member and the inner pipe member such that an inner area of the elastomer member is disposed on the outer surface of the inner pipe member, the elastomer member includes a conductive element embedded therein and expands from a first position to a second position to constrict the dynamic diameter from the first inner pipe member value to the second inner pipe member value responsive to the conductive element receiving an electrical signal from the control unit.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Embodiments of the present disclosure are directed to an expandable elastomer member for controlling the diameter of a tubing member assembly. The expandable elastomer member may include a tubing member assembly that may be utilized to extract gas, hydrocarbons, and other fluids from various depths in a wellbore. The embodiments of the present disclosure, by reducing the diameter of the tubing member assembly, enable the tubing member assembly to maintain a desired critical rate velocity or desired downhole critical rate velocity with which liquids are extracted from various depths of the wellbore in which the tubing member assembly is installed. In embodiments, the tubing member assembly may include an outer pipe member, an inner pipe member, and an elastomer member that is disposed on the inner pipe member and in between inner pipe member and the outer pipe member. An inner area of the elastomer member may be disposed on an outer surface of the inner pipe member. In operation, an electrical signal may be transmitted from the control unit to one or more conductive elements embedded within the elastomer member.

These conductive elements may transfer the received electrical signal to the elastomer, causing an expansion of the elastomer. Additional signals of varying magnitudes may be transmitted to the conductive elements at various intervals, with each signal causing an additional expansion of the elastomer member by a certain magnitude. Prior to, during, and after the expansion of the elastomer member, the elastomer member remains disposed between the inner pipe member and outer pipe member and on the outer surface of the inner pipe member. As a direct result of the expansion of the elastomer member and based on the elastomer member maintaining contact with the outer surface of inner pipe member, the inner and outer diameters of the inner pipe member are constricted. Such a constriction better enables the extraction of liquids from the tubing member assembly, which in turn prevents liquid loading and improves the operational life of the tubing member assemblies.

Figure 1A:
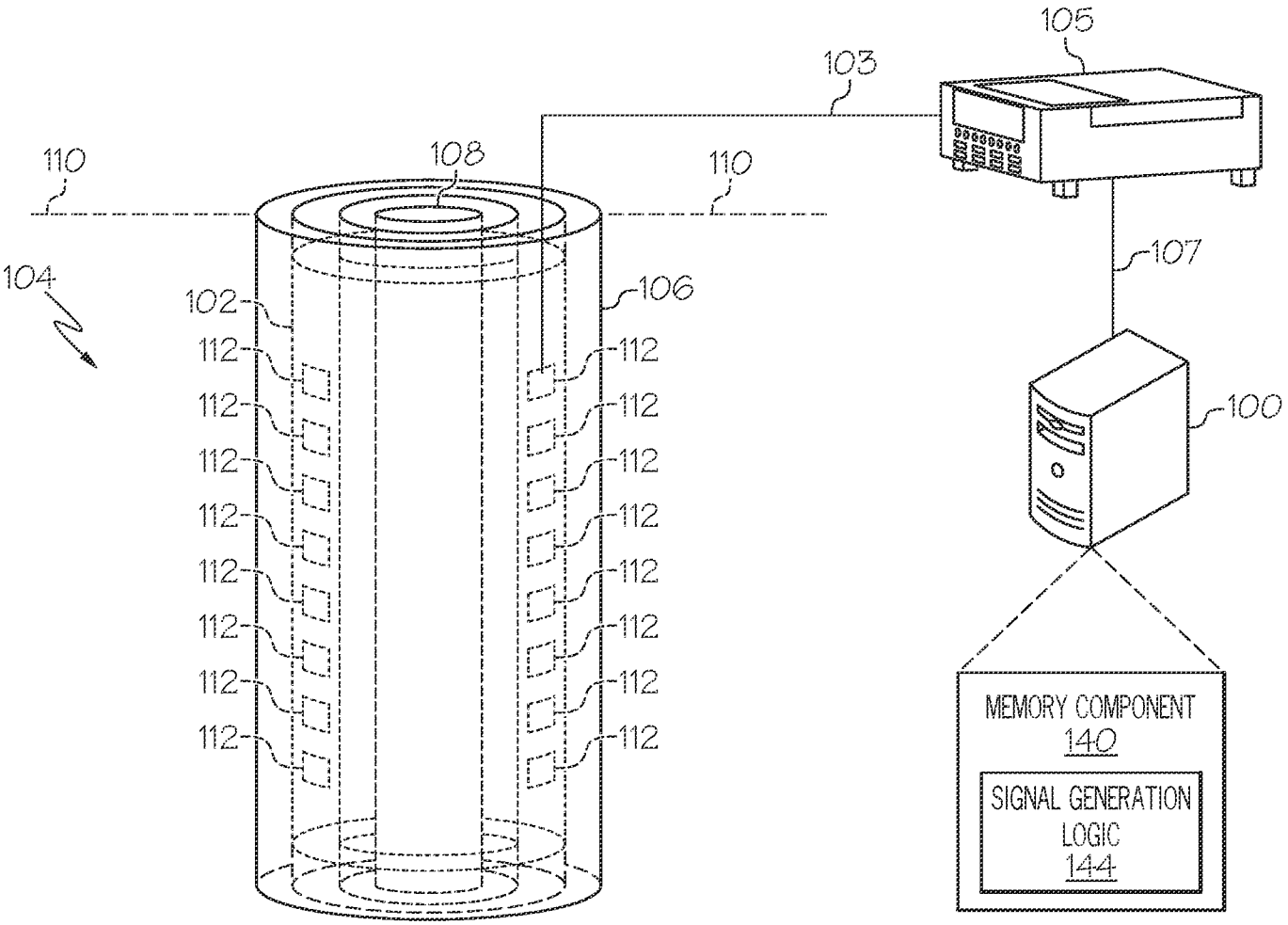
FIG. 1A depicts an expandable elastomer member system, according to one or more embodiments described and illustrated herein.

Referring now to the drawings, FIG. 1A depicts the expandable elastomer member system, according to one or more embodiments described and illustrated herein. As illustrated, a control unit 105 may be communicatively coupled to an elastomer member 102 via a wired connection 103 and a computing device 100 may be communicatively coupled to the control unit 105 via another wired connection 107 or a wireless connection that is implemented using wireless networking hardware. While the control unit 105 and the computing device 100 are illustrated as separate components, the computing device 100 may be installed as part of the control unit 105. The computing device 100 may control the control unit 105 by transmitting instructions to the control unit 105. The computing device 100 and the control unit 105 may be positioned at a surface level 110 of a wellbore in which the tubing member assembly 104 is disposed.

The tubing member assembly 104 may include an outer pipe member 106 and an inner pipe member 108, each of which may have a substantially cylindrical shape, though the pipe members may be designed to have other shapes as well. The outer pipe member 106 may have an outer region and an inner region, and may define a static diameter. The inner pipe member 108 may have an inner surface and an outer surface and may define a dynamic diameter. The inner pipe member 108 may be formed of low carbon steel, low alloyed steel, dura-bar, etc. These materials provide the inner pipe member 108 with a first ductility, e.g., an elongation percentage of 28%, with elongation measured in increments of 50 millimeters until the material severs or fractures. In contrast, the outer pipe member 106 may be formed of medium carbon steel, which provides the outer pipe member 106 with a second ductility, which may be a lower level of ductility relative to the inner pipe member 108. For example, the second ductility may be an elongation percentage of 12%, with the elongation measured in increments of 50 millimeters until the material severs or fractures. In embodiments, each of the outer pipe member 106 and the inner pipe member 108 may be composed of the same material, e.g., L80 grade steel casing pipe, N80 grade steel casing pipe, TN80 grade steel casing pipe, etc. Each of the different types of steel casing pipes having different grades may be useful for different reservoir conditions, e.g., high temperature conditions, conditions involving the presence of carbon dioxide, hydrogen sulfide, etc.

The elastomer member 102, which is illustrated with dotted lines, may be positioned within the tubing member assembly 104 such that the elastomer member 102 is disposed on the inner pipe member 108 and positioned between the outer pipe member 106 and the inner pipe member 108. In particular, the elastomer member 102 may be disposed such that an inner area of the elastomer member 102 directly contacts the outer surface of the inner pipe member 108. In embodiments, the elastomer member 102 may be mechanically adhered to the outer surface of the inner pipe member 108 using fasteners, adhesives, etc. The elastomer member 102 may be formed of materials such as a hydrogenated nitrile material, a hexafluoro-propylene material such as Viton, a tetrafluoro-propylene material such as Aflas, an ethane propylene material, and/or other comparable materials.

While the elastomer member 102 is illustrated as having a height that is less than the height of each of the outer pipe member 106 and the inner pipe member 108, the elastomer member 102 may be designed and installed such that the elastomer height is equal to the height of the outer pipe member 106 and the inner pipe member 108. In some embodiments, a plurality of elastomer members may be installed at various locations between the outer pipe member 106 and the inner pipe member 108, namely on the outer surface of the inner pipe member 108. Each of the multiple elastomer members may be installed on the outer surface of the inner pipe member 108 using mechanical fasteners, adhesives, etc. The elastomer members may be designed to have a height that is smaller than the height of each of the outer pipe member 106 and the inner pipe member 108, e.g., heights that are about 5%, 10%, or 15% of the height of the outer pipe member 106 and the inner pipe member 108.

In embodiments, the control unit 105 may be a direct current generator or an alternating current generator that may be controlled by the computing device 100 positioned within or is external to the control unit 105. The computing device 100 may include a memory component 140 that stores signal generation logic 144. The computing device 100 may include a server, database, personal computer, tablet, mobile device, and/or other device for storing instructions as described in the present disclosure. The computing device 100 may generate instructions to control operation of the control unit 105, which may be stored in the memory component 140 of the computing device 100. Additionally, the generated instructions may be transmitted to the control unit 105, based on which the control unit 105 may generate electrical signals in the form of current of various magnitudes, e.g., about 10 Amps, 20 Amps, 50 Amps, 100 Amps, etc.

One or more electrical signals may be transmitted from the control unit 105 to one or more conductive elements 112 embedded at various locations of the elastomer member 102. The conductive elements 112 may be made of copper, aluminum, and other comparable materials having conductive properties. The locations in the elastomer member 102 where the conductive elements 112 are embedded may vary. In embodiments, the dimensions of the conductive elements 112 may vary. For example, conductive elements 112 having larger dimensions may be embedded at fewer locations on the elastomer member 102. In one example, a number of the elastomer member 102 may be disposed at substantially equally spaced intervals from a topmost portion on the inner pipe member 108 to the bottommost portion of the inner pipe member 108.

Upon receiving an electrical signal, the elastomer member 102 may expand by a certain magnitude, e.g., a magnitude in the range of about 2 inches to about 4 inches. In embodiments, the expansion (e.g., thermal expansion) of the elastomer member 102 in the range of about 2 inches to about 4 inches may be caused by an electrical signal having a magnitude ranging from about 50 amperes to about 300 amperes. It is noted an electrical current having a higher magnitude may also be received to initiate thermal expansion of elastomer member 102.

In embodiments, upon receiving the electrical signal, the conductive elements 112 may route the electrical signal to the elastomer member 102. In particular, the conductive elements 112, embedded within the elastomer member 102 at various locations, may transfer the electrical signal to the elastomer member 102 such that the elastomer member 102 expands in a uniform manner. In embodiments, such an expansion causes a contraction of the inner pipe member 108. In embodiments, the expansion of the elastomer member 102 as a result of receiving an electrical signal may be a thermal expansion of the material of which the elastomer member 102 is formed. The receipt of the electrical signal (e.g., current) may increase the temperature of the material of which the elastomer member 102 is formed, which in turn causes the thermal expansion of the material. In embodiments, the electrical signal that is received by the elastomer member 102 will cause a sudden surge of heat, which will result in an expansion in the elastomer 102. For example, the sudden heat surge may cause the temperature of the elastomer member 102 to exceed a threshold value of, for example, 350 degrees Fahrenheit. In embodiments, the elastomer member 102 may be a FREECAP™ GT packer that may expand upon receiving an electrical signal having a magnitude range as described above. The FREECAP™ GT packer may expand in stages based on varying magnitudes of the electrical signals received by the packer.

In embodiments, as a result of the expansion of the elastomer member 102, the dynamic diameter of the outer surface of the inner pipe member 108 may reduce as a result of direct contact with the inner area of the elastomer member 102. Additionally, the diameter of the inner surface of the inner pipe member 108 may also reduce by a magnitude (e.g., in the range of about 2.5-3.5 inches) as a result of the outer surface of the inner pipe member 108 maintaining direct contact with the inner area of the elastomer member 102. The reduction in the diameter of the inner surface of the inner pipe member 108 reduces instances of liquid loading. Consequently, the operational life and production capability of the tubing member assembly is improved.

Figure 1B:
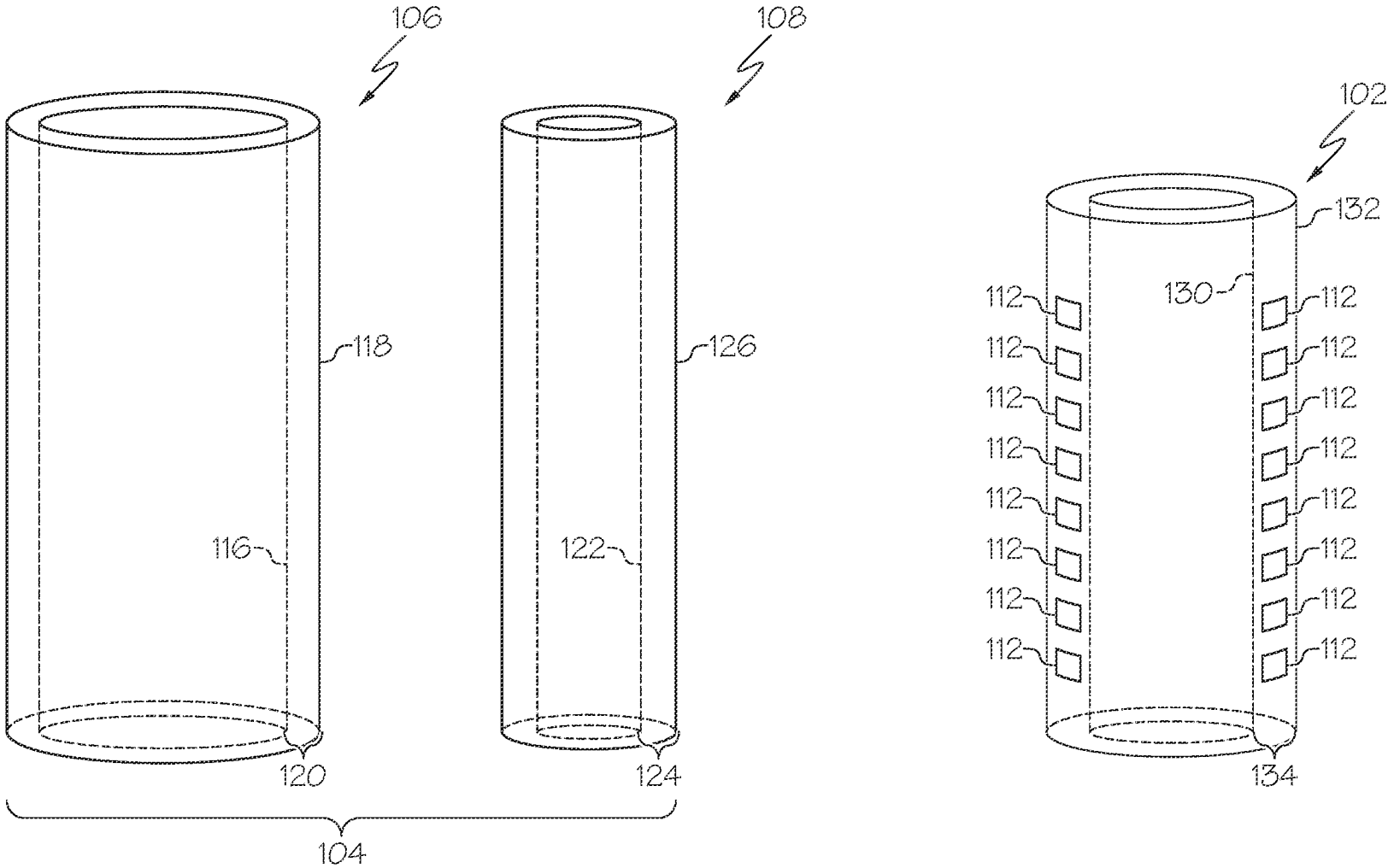
FIG. 1B depicts the elastomer member and each component of the tubing member assembly of the present disclosure separately, according to one or more embodiments described and illustrated herein.

FIG. 1B depicts the elastomer member 102 and each component of the tubing member assembly 104 separately, according to one or more embodiments described and illustrated herein. Specifically, FIG. 1B depicts the outer pipe member 106 and the inner pipe member 108 as separate components. The outer pipe member 106 and the inner pipe member 108, when adhered together with adhesives and/or fasteners, form the tubing member assembly 104. The outer pipe member 106 may have an inner region 116, an outer region 118, and an outer pipe member thickness 120. The outer pipe member thickness 120 may be, e.g., in the range of about 2-7 inches. Additionally, as stated above, the outer pipe member 106 may be formed of medium carbon steel. In contrast, the inner pipe member 108 may be formed of low carbon steel, and as such, may be more ductile than the outer pipe member 106. The ductility of the outer pipe member 106 and the inner pipe member 108 may be altered by increasing the carbon concentration within each pipe member. A higher carbon concentration corresponds to a higher rigidity level. The inner pipe member 108 may include an inner surface 122, an outer surface 126, and an inner pipe member thickness 124. The inner pipe member thickness 124 may also be, e.g., in the range of about 2-7 inches. The elastomer member 102 may include an inner area 130, an outer area 132, an elastomer thickness 134, and the conductive elements 112. The elastomer thickness 134 may be comparable to the thickness values of the outer pipe member 106 and the inner pipe member 108.

Figure 2:
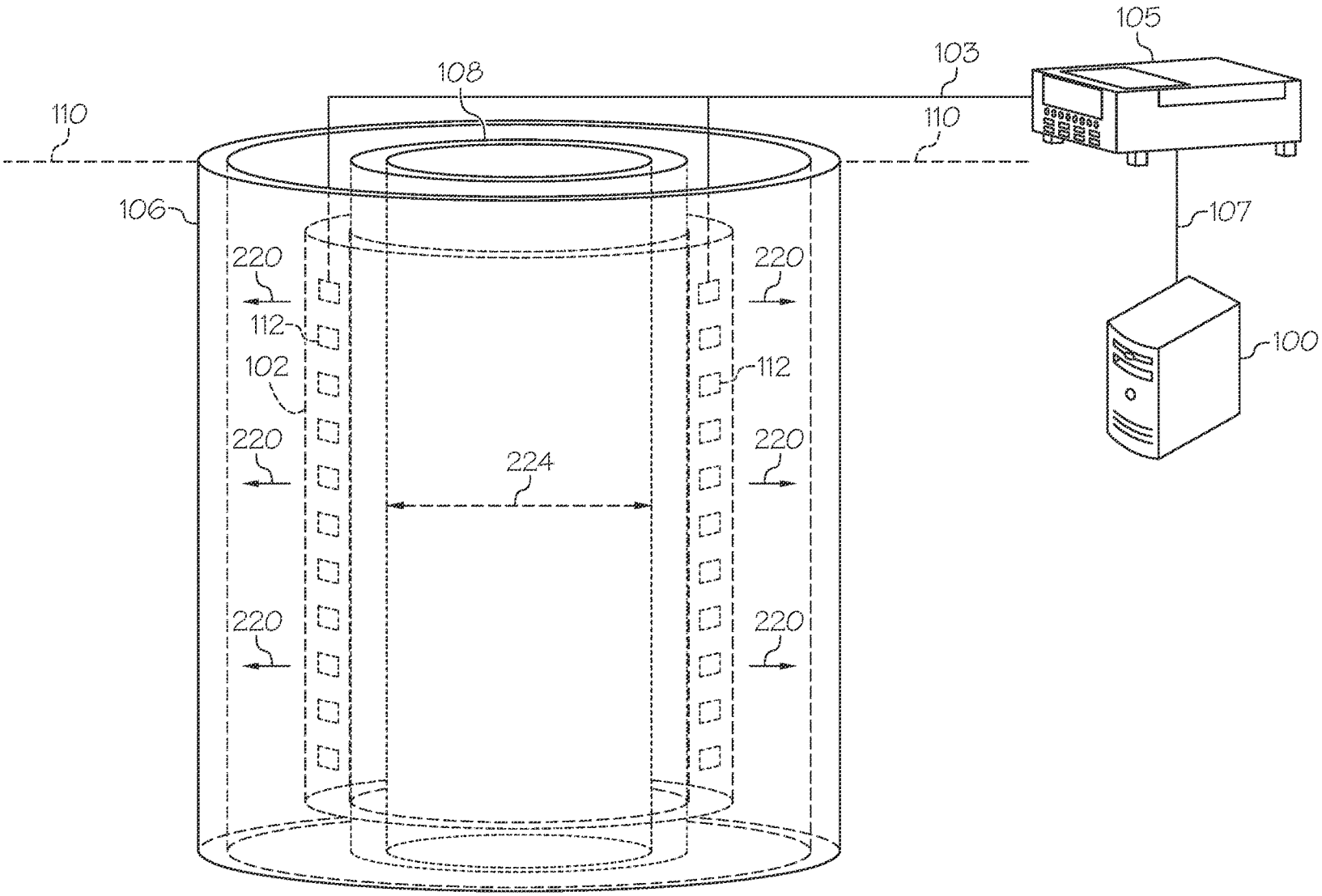
FIG. 2 depicts a direction of expansion of the elastomer member upon receiving an electric signal, according to one or more embodiments described and illustrated herein.

FIG. 2 depicts a direction of expansion of the elastomer member 102 upon receiving an electric signal, according to one or more embodiments described and illustrated herein. As illustrated in FIG. 2, the control unit 105 may transmit an electric signal via the wired connection 103, to one or more of the conductive elements 112 embedded in the elastomer member 102. The elastomer member 102 is illustrated as having a particular thickness, e.g., the elastomer thickness 134. In embodiments, the wired connection 103 may connect the control unit 105 to each of the conductive elements 112 embedded at various locations in the elastomer member 102. The wired connection 103 may be distinct individual wired connections that electrically couple the control unit 105 to each of the conductive elements 112 or may be wired connections that electrical couple the control unit 105 to a subset of the conductive elements 112, and the subset of the conductive elements 112 may be electrically coupled or connected to the remaining set of the conductive elements 112, e.g., as part of a daisy chain configuration. Upon receiving the electrical signal, the conductive elements 112 may transfer the electrical signal to various portions of the elastomer member 102 such that the elastomer member 102 may expand outwards as indicated by outward expansion arrows 220 from a first position to a second position. Prior to the expansion of the elastomer member 102, an inner diameter of the inner pipe members may be a first inner pipe member value 224, which may correspond to a first inner diameter of, e.g., 7 inches.

Figure 3:
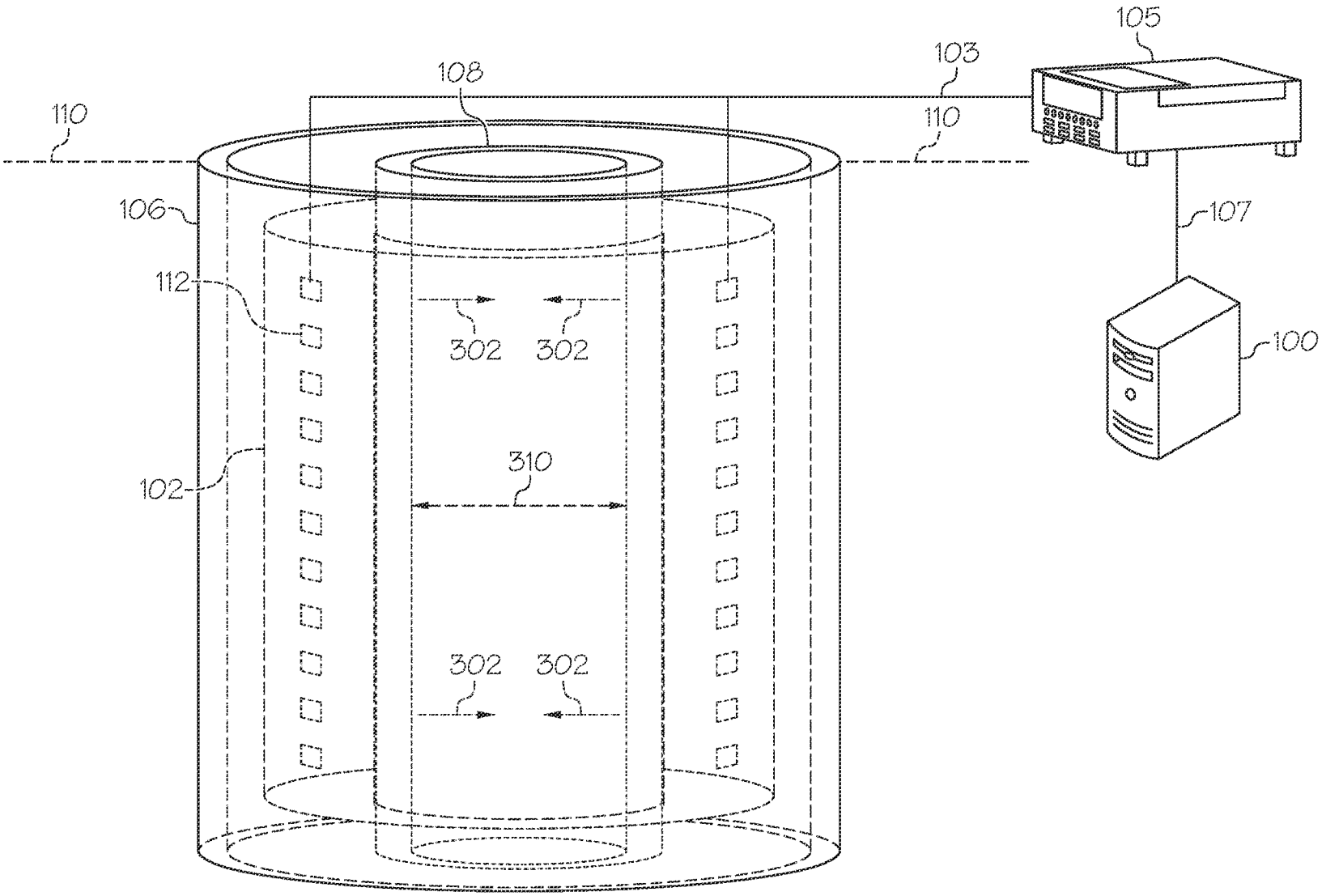
FIG. 3 depicts the elastomer member as having expanded as a result of receiving an electrical signal and the inner pipe member as having contracted based on the expansion of the elastomer member, according to one or more embodiments described and illustrated herein.

FIG. 3 depicts the elastomer member 102 as having expanded as a result of receiving an electrical signal and the inner pipe member 108 as having contracted based on the expansion of the elastomer member 102, according to one or more embodiments described and illustrated herein. After the electrical signal is received by the conductive elements 112 and transferred to various portions of the elastomer member 102, the elastomer member 102 may expand outwards by a certain magnitude, as indicated by the outward expansion arrows 220 of FIG. 2. Additionally, as the inner area 130 of the elastomer member 102 is disposed on or directly contacts the outer surface 126 of the inner pipe member 108, the expansion of the elastomer member 102 results in expansion of the elastomer member 102 inward, causing contact with and thus a contraction of the inner pipe member 108, as indicated by a contraction direction 302. In particular, the inner diameter of the inner pipe member 108 may reduce from a first inner pipe member value 224 to a second inner pipe member value 310. In particular, the second inner pipe member value 310 may be a second inner diameter of 4.5 inches, which is lower than the first inner diameter of 7 inches as described above.

Figure 4:
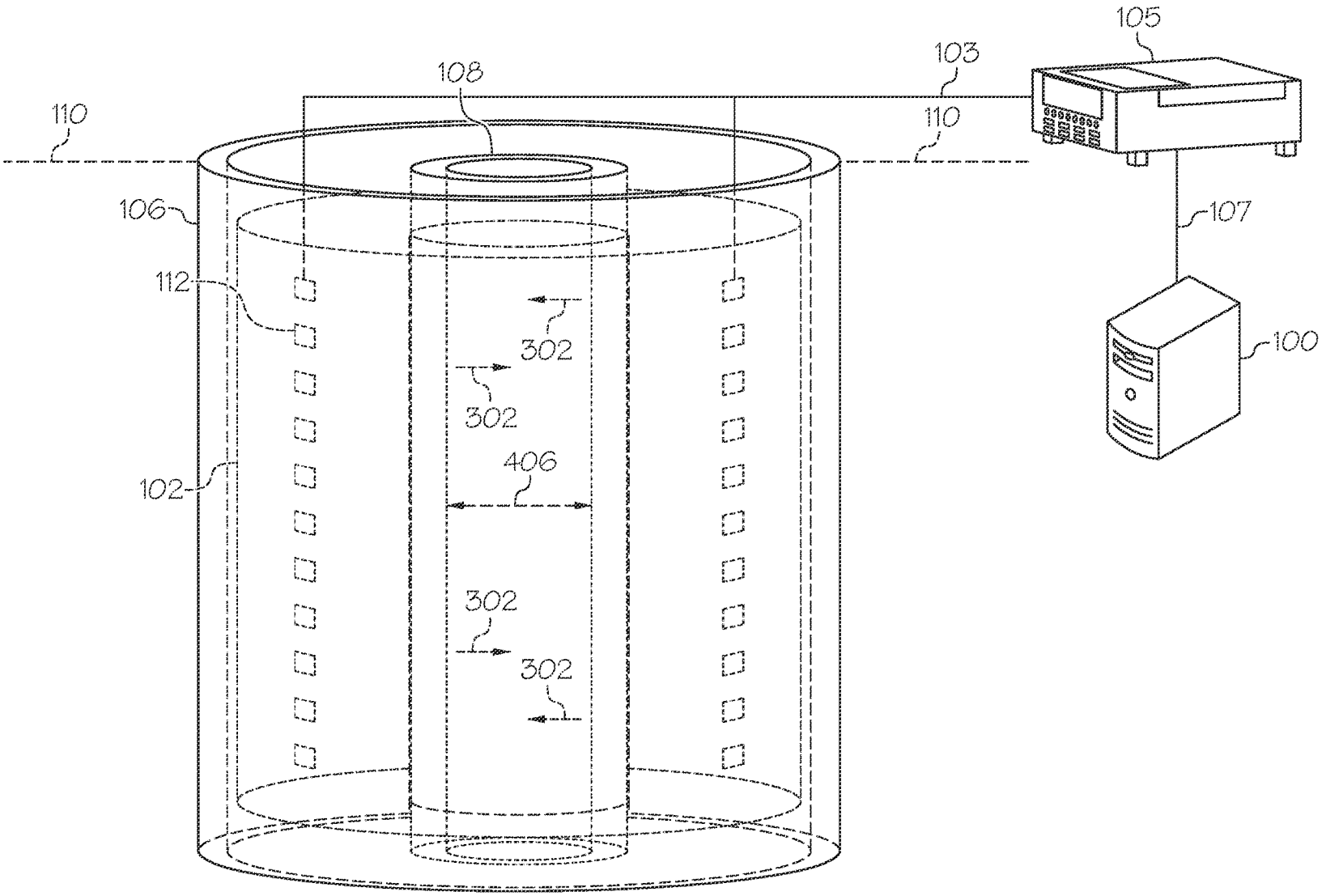
FIG. 4 depicts the elastomer member as having further expanded as a result of receiving an additional electrical signal and the inner pipe member as having further contracted based on the additional expansion of the elastomer member, according to one or more embodiments described and illustrated herein.

FIG. 4 depicts the elastomer member 102 as having further expanded as a result of receiving an additional electrical signal and the inner pipe member 108 as having further contracted based on the additional expansion of the elastomer member 102, according to one or more embodiments described and illustrated herein. As illustrated, the conductive elements 112 embedded within the elastomer member 102 may receive another electrical signal in the form of a current of a higher magnitude than the electrical signal described above. The conductive elements 112 may transfer the received electrical signal to the elastomer member 102 such that the elastomer member 102 may further expand in a uniform manner. In particular, the elastomer member 102 may expand from the second position to a third position.

As a result of the inner area 130 of the elastomer member 102 directly contacting and maintaining contact with the outer surface 126 of the inner pipe member 108, the inner pipe member 108 may further contract in the contraction direction 302, which further reduces the inner diameter of the inner pipe member 108 from the second inner pipe member value 310 (e.g., 4.5 inches) to a third inner pipe member value 406 (e.g., 2.3 inches). In embodiments, one or more additional electrical signals may be generated by the control unit 105 and transmitted to the conductive elements 112 in order to further expand the elastomer member 102 until the elastomer member 102 reaches a threshold expansion level. The threshold expansion level may be reached as a result of the outer area 132 of the elastomer member 102 expanding multiple times until the outer area 132 directly contacts the inner region 116 of the outer pipe member 106, which may be made of rigid carbon steel and have limited ductility. As such, any further expansion of the elastomer member 102 may be restricted by the rigidity of the outer pipe member 106.

The present disclosure describes embodiments of an expandable elastomer member system that enables the reduction of a tubing member assembly, namely inner diameters of various pipe members included within the tubing member assembly, in real time. Such a reduction enables the tubing member assembly to maintain a certain velocity (i.e. critical rate or downhole critical rate) with which liquids may be extracted, which allows the tubing member assembly to extract large volumes of liquids that may have accumulated at various depths of the wellbore in which the tubing is positioned. Consequently, instances of liquid loading are improved and the production and extraction capability of the tubing member assembly are improved.

Figure 5:
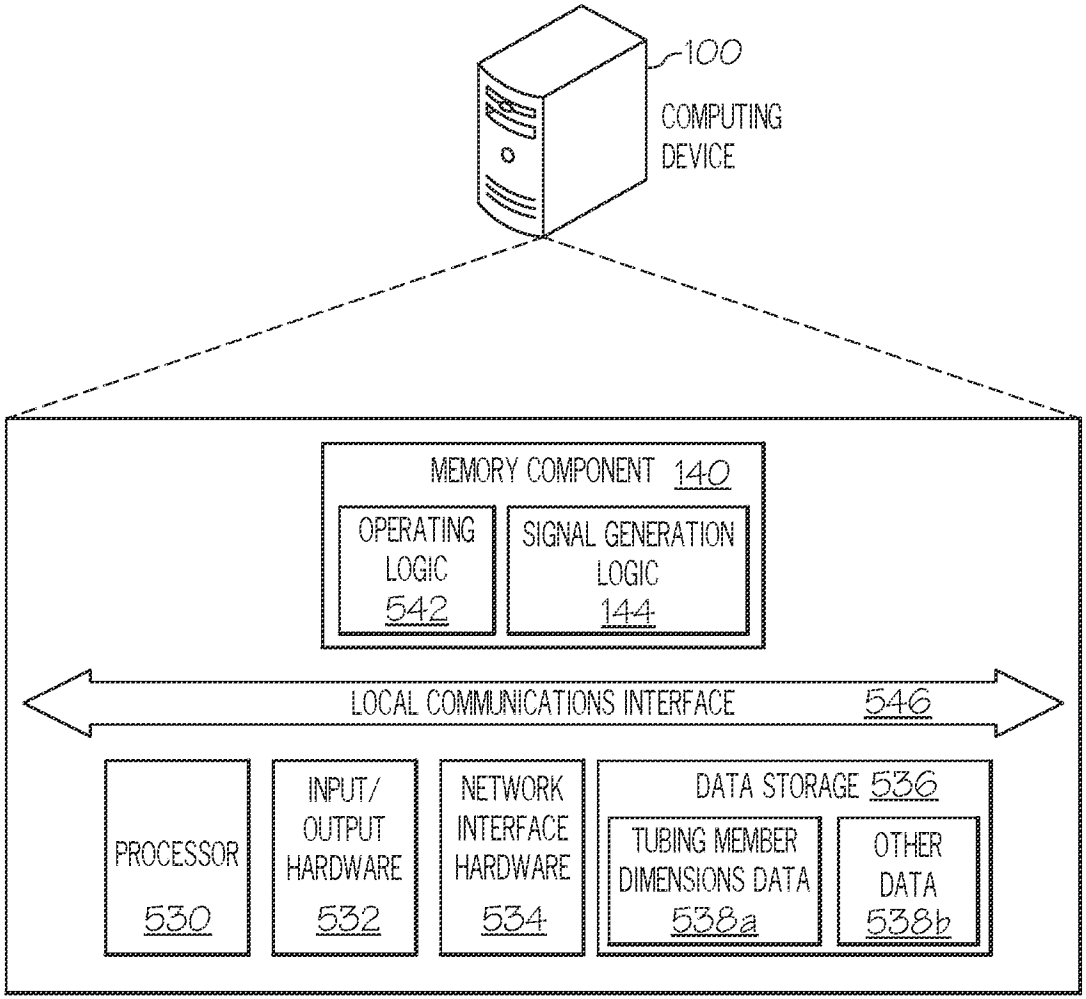
FIG. 5 depicts a computing device that transmits instructions for operating the control unit of the present disclosure, according to embodiments described and illustrated herein.

FIG. 5 depicts a computing device 100 that transmits instructions for operating the control unit 105, according to embodiments provided herein. As stated, the computing device 100 may be included as part of the control unit 105 or may be external to the control unit 105 and be configured to instruct the control unit 105 to generate electrical signals of various magnitudes, which may be transmitted to the elastomer member 102 in order to expand the elastomer member 102. As such, it should be noted that the control unit 105 may operate as an independent application specific device, instead of a general purpose computer as depicted in FIG. 5. Accordingly, the control unit may include the described hardware and software for implementing the functionality described herein.

As illustrated, the computing device 100 includes a processor 530, input/output hardware 532, a network interface hardware 534, a data storage component 536 (which may store tubing member dimensions data 538*a*, and other data 538*b* such as elastomer member dimensions data, pipe member dimensions data, etc.), and a memory component 140. The memory component 140 may be configured as volatile and/or nonvolatile memory and as such, may include random access memory (including SRAM, DRAM, and/or other types of RAM), flash memory, secure digital (SD) memory, registers, compact discs (CD), digital versatile discs (DVD) (whether local or cloud-based), and/or other types of non-transitory computer-readable medium. Depending on the particular embodiment, these non-transitory computer-readable mediums may reside within the computing device 100 and/or external to the computing device 100.

The memory component 140 may store operating logic 542 and the signal generation logic 144. Each of these logic components may include a plurality of different pieces of logic, each of which may be embodied as a computer program, firmware, and/or hardware, as an example. A local interface 546 is also included in FIG. 5 and may be implemented as a bus or other communication interface to facilitate communication among the components of the computing device 100.

The processor 530 may include any processing component operable to receive and execute instructions (such as from a data storage component 536 and/or the memory component 140). As described above, the input/output hardware 532 may include and/or be configured to interface with speakers, microphones, and/or other input/output components.

The network interface hardware 534 may include and/or be configured for communicating with any wired or wireless networking hardware, including an antenna, a modem, a LAN port, wireless fidelity (Wi-Fi) card, WiMAX card, mobile communications hardware, and/or other hardware for communicating with other networks and/or devices. From this connection, communication may be facilitated between the computing device 100 and other computing devices.

The operating logic 542 may include an operating system and/or other software for managing components of the computing device 100. As discussed above, the signal generation logic 144 may reside in the memory component 140 and may be configured to generate instructions and transmit these instructions to the control unit 105. The control unit 105 may then generate, based on these instructions, one or more electrical signals (e.g., current) of a particular magnitude and transmit the one or more electrical signals to the elastomer member 102 for the purpose of expanding the elastomer member 102.

It should be understood that certain embodiments described herein are directed to a system for controlling the contraction of tubing member assemblies. The system includes a control unit, a computing device that is communicatively coupled to the control unit that includes a memory component that stores logic and a processor for executing the logic, a tubing member assembly, and an elastomer member. The tubing member assembly includes an outer pipe member having an inner region and defining a static diameter and an inner pipe member having an outer surface and defining a dynamic diameter that changes from at least a first inner pipe member value to a second inner pipe member value, wherein the dynamic diameter is always smaller than the static diameter, and wherein the inner pipe member is disposed within the outer pipe member. The elastomer member, which is communicatively coupled to the control unit, is disposed between the outer pipe member and the inner pipe member such that an inner area of the elastomer member is disposed on the outer surface of the inner pipe member, and the elastomer member expands from a first position to a second position to constrict the dynamic diameter from the first inner pipe member value to the second inner pipe member value responsive to receiving an electrical signal from the control unit.

The terminology used herein is for the purpose of describing particular aspects only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A system comprising:

a control unit that provides an electrical signal;

a computing device that is communicatively coupled to the control unit and includes a memory component that stores logic and a processor for executing the logic;

a tubing member assembly including an outer pipe member having an inner region, the outer pipe member defining a static diameter and an inner pipe member, the inner pipe member having an outer surface, the inner pipe member defining a dynamic diameter configured to change from at least a first inner pipe member value to a second inner pipe member value, wherein the dynamic diameter is smaller than the static diameter, and wherein the inner pipe member is disposed within the outer pipe member; and an elastomer member, communicatively coupled to the control unit, that is disposed between the outer pipe member and the inner pipe member such that an inner area of the elastomer member is disposed on the outer surface of the inner pipe member, and wherein the elastomer member is configured to expand from a first position to a second position to constrict the dynamic diameter from the first inner pipe member value to the second inner pipe member value responsive to receiving the electrical signal from the control unit.

2. The system of claim 1, wherein the elastomer member is further configured to expand from the second position to a third position responsive to receiving an additional electrical signal.

3. The system of claim 2, wherein the dynamic diameter is further constricted from the second inner pipe member value to a third inner pipe member value based on the inner area of the elastomer member remaining disposed on the outer surface of the inner pipe member as the elastomer member further expands from the second position to the third position.

4. The system of claim 1, wherein the elastomer member includes conductive elements embedded therein and is formed of at least one of the following: a hydrogenated nitrile material, a hexafluoro-propylene material, a tetrafluoro-propylene material, or an ethane propylene.

5. The system of claim 1, wherein a first carbon concentration of the inner piper member is lower than a second carbon concentration of the outer pipe member.

6. The system of claim 1, wherein the inner pipe member has a first ductility that is higher than a second ductility of the outer pipe member.

7. An system comprising:

a control unit that provides an electrical signal;

a computing device that is communicatively coupled to the control unit and includes a memory component that stores logic and a processor for executing the logic;

an outer pipe member;

an inner pipe member having an outer surface and defining a dynamic diameter;

an elastomer member that is disposed between the outer pipe member and the inner pipe member such that an inner area of the elastomer member is disposed on the outer surface of the inner pipe member, wherein the elastomer member:

is configured to receive the electrical signal from the control unit; and is configured to expand from a first position to a second position to constrict the dynamic diameter of the inner pipe member from a first inner pipe member value to a second inner pipe member value responsive to the electrical signal from the control unit.

8. The system of claim 7, wherein the outer pipe member has an inner region and defines a static diameter.

9. The system of claim 8, wherein the dynamic diameter of the inner pipe member is always smaller than the static diameter.

10. The system of claim 8, wherein the inner pipe member is disposed within the static diameter defined by the outer pipe member.

11. The system of claim 7, wherein the elastomer member is further is configured to expand from the second position to a third position responsive to receiving an additional electrical signal.

12. The system of claim 11, wherein the dynamic diameter is configured to be further constricted from the second inner pipe member value to a third inner pipe member value based on the inner area of the elastomer member remaining disposed on the outer surface of the inner pipe member as the elastomer member further expands from the second position to the third position.

13. The system of claim 7, wherein the elastomer member is formed of at least one of the following: a hydrogenated nitrile material, a hexafluoro-propylene material, a tetrafluoro- propylene material, or an ethane propylene.

14. The system of claim 7, wherein the inner pipe member has a first ductility that is higher than a second ductility of the outer pipe member.

15. The system of claim 7, wherein the outer pipe member has a first carbon concentration that is higher than a second carbon concentration of the inner pipe member.

16. The system of claim 7, wherein the elastomer member includes a conductive element.

17. A system comprising:

a control unit that provides an electrical signal;

a computing device that is communicatively coupled to the control unit and includes a memory component that stores logic and a processor for executing the logic;

a tubing member assembly including an outer pipe member having an inner region, the outer pipe member assembly defining a static diameter, the tubing member assembly further including an inner pipe member having an outer surface and defining a dynamic diameter configured to change from at least a first inner pipe member value to a second inner pipe member value, wherein the dynamic diameter is smaller than the static diameter, and wherein the inner pipe member is disposed within the outer pipe member; and an elastomer member, communicatively coupled to the control unit, that is disposed between the outer pipe member and the inner pipe member such that an inner area of the elastomer member is disposed on the outer surface of the inner pipe member, the elastomer member including a conductive element embedded therein and wherein the elastomer member is configured to expand from a first position to a second position to constrict the dynamic diameter from the first inner pipe member value to the second inner pipe member value responsive to the conductive element receiving the electrical signal from the control unit.

18. The system of claim 17, wherein the elastomer member is configured to expand from the second position to a third position responsive to the conductive element receiving an additional electrical signal, and the dynamic diameter is further constricted from the second inner pipe member value to a third inner pipe member value based on the inner area of the elastomer member remaining disposed on the outer surface of the inner pipe member as the elastomer member further expands from the second position to the third position.

19. The system of claim 17, wherein the outer pipe member has a first carbon concentration that is higher than a second carbon concentration of the inner pipe member.

* * * * *